US010987711B2

(12) United States Patent
Frobose

(10) Patent No.: US 10,987,711 B2
(45) Date of Patent: Apr. 27, 2021

(54) ROLL STRAIGHTENING MACHINE AND METHOD FOR PRODUCING AN ELONGATED STRING MEMBER

(71) Applicant: SANDVIK MATERIALS TECHNOLOGY DEUTSCHLAND GMBH, Dusseldorf (DE)

(72) Inventor: Thomas Frobose, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 1030 days.

(21) Appl. No.: 15/553,094

(22) PCT Filed: Jan. 27, 2015

(86) PCT No.: PCT/EP2015/051606
§ 371 (c)(1),
(2) Date: Aug. 23, 2017

(87) PCT Pub. No.: WO2015/113971
PCT Pub. Date: Aug. 6, 2015

(65) Prior Publication Data

US 2018/0029093 A1 Feb. 1, 2018

(30) Foreign Application Priority Data

Jan. 29, 2014 (DE) ..... 102014101101.5

(51) Int. Cl.
*B21B 31/08* (2006.01)
*B21D 3/04* (2006.01)
*B21B 31/02* (2006.01)

(52) U.S. Cl.
CPC ..... *B21B 31/08* (2013.01); *B21B 31/02* (2013.01); *B21D 3/04* (2013.01)

(58) Field of Classification Search
CPC ..... B21B 31/08; B21B 31/02; B21B 31/10; B21B 31/103; B21B 31/16; B21B 31/18;
(Continued)

(56) References Cited

U.S. PATENT DOCUMENTS 2,838,090 A * 6/1958 Skawden ..... B21D 3/04 72/98
2,987,096 A 6/1961 McConnel
(Continued)

FOREIGN PATENT DOCUMENTS

CN 202270781 U 6/2012
CN 202951708 U 5/2013
(Continued)

OTHER PUBLICATIONS

Office Action dated Jun. 4, 2018, issued in corresponding Chinese Patent Application No. 201580006409.7.
(Continued)

*Primary Examiner* — Shelley M Self
*Assistant Examiner* — Jared O Brown
(74) *Attorney, Agent, or Firm* — Morgan, Lewis & Bockius LLP

(57) ABSTRACT

A roll straightening machine for straightening an elongated string member includes at least one first straightening roll rotatably mounted around a first rotation axis, and at least one second straightening roll rotatably mounted around a second rotation axis. The first and second rotation axis and rolls are oblique with respect to a longitudinal axis of an elongated string member to be received in the roll straightening machine, and also oblique with respect to one another. In order to provide a roll straightening machine that can be set up flexibly for different requirement profiles, the first rotation axis is mounted on a first holding device and the second rotation axis is mounted on a second holding device.
(Continued)

The first and the second holding devices are supported by a frame in a removable manner, which is arranged to receive a variable number of holding devices having the straightening rolls.

22 Claims, 4 Drawing Sheets

(58) Field of Classification Search
CPC ..... B21B 31/20; B21B 31/22; B21B 31/24; B21D 3/04; B21D 3/01; B21D 3/02; B21D 3/05; B21D 3/16; B21D 37/10; B21D 37/12; B21D 37/14
USPC ..... 72/239
See application file for complete search history.

(56) References Cited

U.S. PATENT DOCUMENTS 3,604,236 A * 9/1971 Hyams ..... B21D 3/04 72/99
3,858,425 A * 1/1975 Thompson ..... B21B 33/00 72/245
4,471,639 A * 9/1984 Gerber ..... B21D 3/04 72/10.3
4,516,454 A * 5/1985 Mosburger ..... B26D 7/2635 83/425.4
4,719,781 A * 1/1988 Cloup ..... B21F 1/02 72/162
5,044,186 A * 9/1991 Taylor ..... B21D 3/04 72/31.08
2018/0029093 A1* 2/2018 Frobose ..... B21D 3/04

FOREIGN PATENT DOCUMENTS

GB 2085781 A 5/1982
JP 59144526 A * 8/1984 ..... B21D 3/02
JP 2002-192233 A 7/2002

OTHER PUBLICATIONS

Office Action dated Jan. 20, 2021, issued in corresponding Korean Patent Application No. 10-2016-7023599.

* cited by examiner

Fig. 4
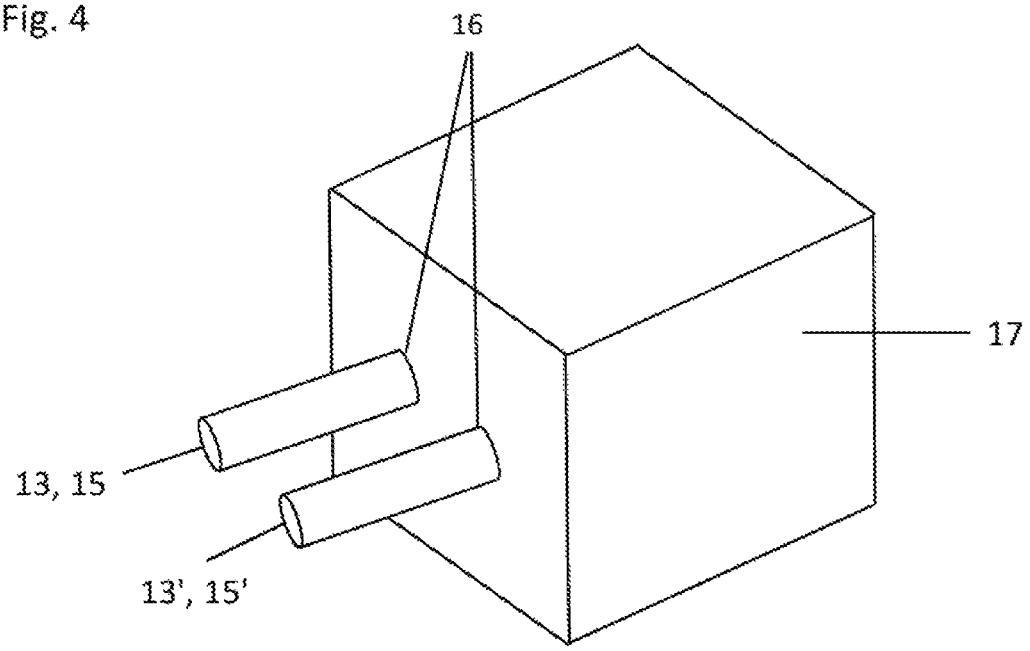
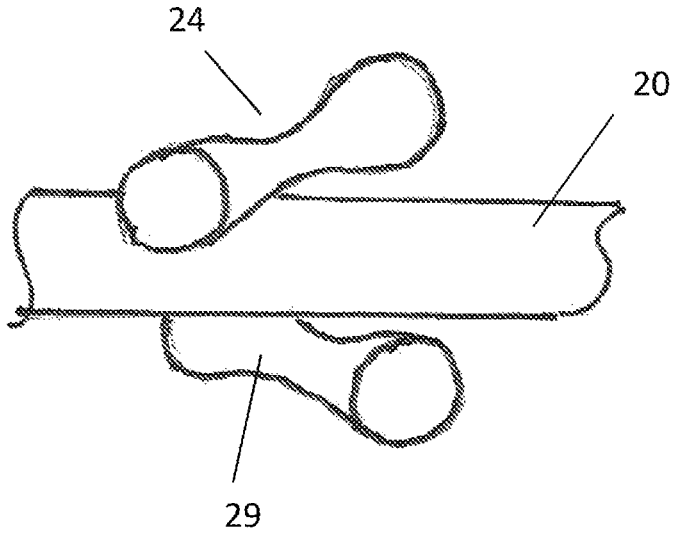
Fig. 5

ROLL STRAIGHTENING MACHINE AND METHOD FOR PRODUCING AN ELONGATED STRING MEMBER

RELATED APPLICATION DATA

This application is a § 371 National Stage Application of PCT International Application No. PCT/EP 2015/051606 filed Jan. 27, 2015 claiming priority of DE 102014101101.5 filed Jan. 29, 2014.

TECHNICAL FIELD

The present invention relates to a roll straightening machine for straightening an elongated string member, having at least one first straightening roll, which is rotatably mounted around a rotation axis and motor-driven, and at least one second straightening roll, which is rotatably mounted around a second rotation axis and motor-driven, wherein the first and the second rotation axis are oblique with respect to a longitudinal axis of an elongated string member to be received in the roll straightening machine, and wherein the first and the second rotation axis are oblique with respect to one another.

The present invention further relates to a method for producing an elongated string member, comprising the steps: provision of an elongated string member to be straightened and straightening of the elongated string member with a roll straightening machine which comprises at least one first straightening roll, which is mounted rotatably about a first rotation axis and motor-driven, and at least one second straightening roll, which is rotatably mounted about a second rotation axis and motor-driven, wherein the first and second rotation axis are oblique with respect to a longitudinal axis of the elongated string member to be straightened, and wherein the first and the second rotation axis are oblique with respect to one another.

BACKGROUND

Elongated string members made of steel, in particular tubes made of stainless steel, are frequently subjected, after cold forming, to a heat treatment, for example, by annealing. In the process, a deformation of the tube with regard to its straightness occurs.

However, modern uses of stainless steel tubes are associated with very stringent requirements in terms of the straightness of the tubes. Thus, it is not rare that a tube must not present a deviation of more than 0.2 mm from straightness over one meter reference length. A ruler having a length of one meter when placed against the tube outer surface must at no site be more than a distance of 0.2 mm away from the tube outer surface.

For restoring the required straightness of the tubes after a heat treatment, straightening machines are therefore used in order to straighten the tubes. The most important machine groups for straightening tubes are so-called continuously operating inclined roll straightening machines. In the process, the tube is run between and in engagement with at least two rolls the rotation axis of which are oblique with respect to the tube and relative to one another.

However, depending on the tube to be straightened, a different number of straightening rolls or a different number of pairs of straightening rolls is required.

Therefore, manufacturers of tubes to date have always kept available a plurality of roll straightening machines in order to be able to cover the different application cases for different tubes.

SUMMARY

In contrast, the problem of the present invention is to provide a roll straightening machine that can be set up flexibly for different requirement profiles.

The above-mentioned problem is solved by a roll straightening machine for straightening an elongated string member, having at least one first straightening roll, which is rotatably mounted around a first rotation axis and motor-driven, and at least one second straightening roll, which is rotatably mounted around a second rotation axis and motor-driven, wherein the first and the second rotation axis are oblique with respect to a longitudinal axis of an elongated string member to be received in the roll straightening machine and wherein the first and the second rotation axis are oblique with respect to one another, wherein the first rotation axis is mounted on a first holding means, the second rotation axis is mounted on a second holding means, and wherein the first and the second holding means are supported by a frame in a removable manner, which is adapted to receive a variable number of holding means with straightening rolls.

If an elongated string member to be straightened is run through between the straightening rolls in engagement with said rolls of the roll straightening machine, roll, wherein the rolls driven by a motor rotate around their rotation axis, then the elongated string member undergoes a bending deformation, which on average leads to the elongated string member leaving the roll straightening machine in a straightened state.

For this purpose, in an embodiment of the invention, the rolls have outer surfaces that deviate from a cylindrical shape. It is advantageous if, in an embodiment, at least one of the rolls has a concavely curved outer surface, wherein the concave curvature, in an embodiment, has a hyperbolic profile in the radial sectional plane.

In the sense of the present invention, an elongated string member to be straightened by means of the roll straightening machine is a longitudinally extending body with a preferably circular cross section, i.e., in particular a round rod or a tube.

The obliqueness of the first and second rotation axis with respect to one another as well as with respect to the longitudinal axis of an elongated string member to be received in the roll straightening machine means that the rotation axis enclose an angle so that they are not parallel to one another, and the rotation axis enclose an angle with the longitudinal axis of the elongated string member to be straightened such that the rotation axis do not extend parallel to the longitudinal axis of the elongate string member.

A crucial factor for the functionality of the roll straightening machine according to the invention is that the at least two rolls with their respective holding means are received in a removable manner on the frame of the machine. In this manner, a simple and modular exchange of the straightening rolls is possible, so that the machine can be set up for different requirement profiles.

In particular, it has been shown that different elongated string members to be straightened require a different number of straightening rolls. Therefore, it is a crucial characteristic of the roll straightening machine according to the present invention that the frame is arranged such that on the frame a variable number of holding means with rolls received thereon can be mounted. Thus, the same frame of the roll straightening machine can be provided with an entirely different number of straightening rolls.

In order to ensure this modularity and variability, the frame, in an embodiment, comprises at least one rail on which the holding means with a straightening roll can be received.

In an embodiment it is advantageous for the frame to comprise at least one first rail and one second rail, wherein on the first rail a first holding means with a straightening roll is received and on the second rail a second holding means with a straightening roll is received.

In this manner, a changeable and adjustable number of pairs of straightening rolls can be mounted on the roll straightening machine.

In an embodiment of the invention, the first and the second holding means each have a through hole through which the first or the second rail of the frame extends.

A rail in the sense of the present application is a longitudinally extending profile, in particular a profile with a circular cross section, i.e., a rod.

To prevent, for example, turning of the holding means on a rod-shaped profile with circular cross section, it is advantageous once in an embodiment of the invention the straightening machine comprises a first pair of rails and a second pair of rails, wherein the first and the second holding means each comprise a pair of through holes, wherein the first pair of rails extends through the pair of through holes of the first holding means and the second pair of rails extends through the pair of passage holes of the second holding means.

Here, an advantageous embodiment of the invention is one in which the first pair of rails is arranged vertically beneath the second pair of rails on the frame, wherein the four rails extend parallel to one another. In this manner, in each case, one straightening roll of a pair of straightening rolls can be arranged on the straightening machine at the top and the other roll at the bottom.

It has turned out that it is particularly advantageous if, in an embodiment, a roll straightening machine comprises three or more straightening rolls. Therefore, in an embodiment, on each pair of rails, a plurality of holding means with a straightening roll is received, wherein it is preferable that the number of rolls received on each pair of rails with their holding means is the same.

In an embodiment of the invention, a rail has a stop on a first end and a thread on a second end, wherein, on the thread, a nut is arranged by means of which a plurality of holding means is pressed in the direction of the stop.

Here, a stop is to be understood to refer to any element that is arranged and formed in such a manner that it prevents a holding means from sliding down off the rail. By tightening the nut on the thread of the rail, a holding means, and, in particular, a plurality of holding means, can be clamped against one another and against the stop of the rail.

Here, it is advantageous for the nut to comprise a hydraulic nut by means of which the holding means or the plurality of holding means can be rigidly clamped on the rail.

In order to ensure the required stability of a roll module comprising holding means, rotation axis and straightening roll, the holding means, in an embodiment of the invention, has a substantially cuboid base body, which is slid by means of one or more through holes onto at least one rail.

Here, it has turned out to be advantageous for the modularity of the roll straightening machine according to the invention, if, in an embodiment of the invention, all the holding means have an identical construction or design with identical dimensions, in particular with identical longitudinal extension.

In an embodiment of the invention, the length of a rail between the thread and the stop is approximately an exact whole-number multiple of the longitudinal extension of a single holding means. However, in an embodiment of the invention, it is preferable for the length of a rail between the thread and the stop to be a whole-number multiple of the longitudinal extension of a single holding means plus a residual length, wherein, on the rail, a spacer or a plurality of spacers is received, whose entire longitudinal extension is equal to the residual length.

For example, if the length of the rail is six times the longitudinal extension of a holding means, then it is possible to slide, one after the other, six holding means with straightening rolls attached therein onto the rail. In this manner, in this example, at most a twelve-roll straightening machine can be implemented. The fact that the length of a rail between the thread and the stop is approximately a whole-number multiple, takes into account that, for example, washers or the like can be provided between the holding means. On an optionally present residual length of the rail, a spacer or a plurality of spacers can be received, whose longitudinal extensions or whose total longitudinal extension corresponds approximately to the residual length.

However, this solution also makes it possible to provide fewer holding means with the straightening rolls mounted thereon on a rail than the number corresponding to the integer which results from dividing the length of the rail by the longitudinal extension of the holding means, if applicable minus the residual length.

For example, in such a case, it is advantageous if, on the rail, in addition to the holding means with the straightening rolls, at least one spacer as place holder is supported, which has the same longitudinal extension as the holding means, or if a plurality of spacers as place holders is supported, which together have a longitudinal extension like one or more holding means.

In this manner, on a frame with a rail length that is designed, for example, for a twelve-roll straightening machine, i.e., for supporting six holding means on each rail or on each pair of rails, a roll straightening machine can be implemented with only five or fewer pairs of holding means with associated straightening rolls. Thus, for example, on the same frame, a ten-roll straightening machine can be implemented.

In an embodiment of the invention, on one holding means, but preferably on each holding means, a polishing means is provided, which is set up so that, during the operation of the straightening machine, the roll mounted on the holding means can be polished. In this manner, any deformations and damage to the surface of a straightening roll can be removed by polishing during the operation of the roll straightening machine.

For this purpose, a particularly advantageous embodiment according to the invention is one in which the motor-driven polishing means can be fed towards the roll.

In addition, the above-mentioned problem is also solved by a method for producing an elongated string member, which comprises the steps: providing an elongated string member to be straightened and straightening the elongated string member with a roll straightening machine, which comprises at least one first straightening roll, which is rotatably mounted around a first rotation axis and motor-driven, and at least one second straightening roll, which is rotatably mounted around a second rotation axis and motor-driven, wherein the first and second rotation axis are oblique with respect to a longitudinal axis of the elongated string member to be straightened roll, wherein the first and the second rotation axis are oblique with respect to one another, and wherein, furthermore, in the roll straightening machine used for the straightening, the first rotation axis is mounted on a first holding means, the second rotation axis is mounted on a second holding means, and the first and the second holding means are supported on a frame in a removable manner, which is adapted to receive a variable number of holding means with straightening rolls.

In an embodiment of the method according to the invention, a stainless steel tube is straightened as an elongated string member.

In an additional embodiment of the invention, before the straightening, the stainless steel tube is cold formed from a hollow to form the tube, in particular by cold pilgering roll or by cold drawing.

In an embodiment, the tube is annealed in an annealing furnace between the cold forming and the straightening.

To the extent that aspects of the invention have been described above with regard to the roll straightening machine, they also apply to the corresponding method for producing an elongated string member and vice versa. To the extent that the method for production is effected with a roll straightening machine according to this invention, the roll straightening machine or the production installation in general comprises the appropriate means for that purpose. In particular, embodiments of the roll straightening machine or of the production installation are suitable for implementing the described embodiments of the method and comprise, in embodiments thereof, the means required for that purpose.

Further advantages, features and applications of the invention become apparent on basis of the present description of an embodiment and the corresponding figures.

BRIEF DESCRIPTION OF THE DRAWINGS

FIG. 4 is a perspective view of the holding means of FIGS. 1 and 2.

FIG. 5 is a perspective view of the rolls of FIGS. 1 and 2.

In the figures, identical elements are marked with identical reference numerals.

DETAILED DESCRIPTION

Figure 1:
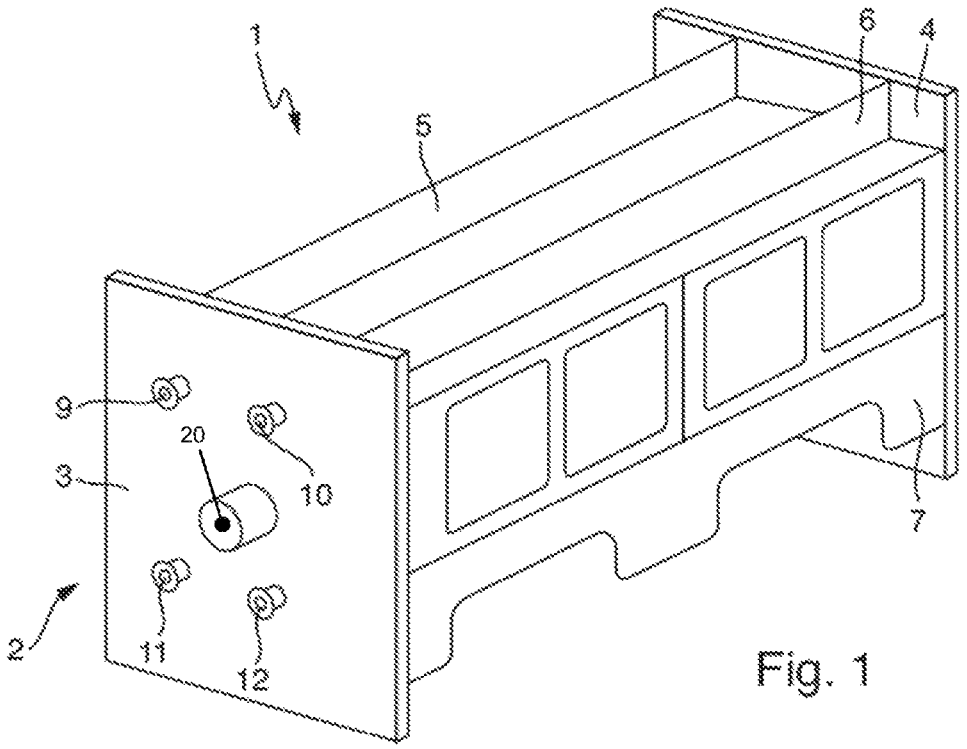
FIG. 1 shows a perspective view of a roll straightening machine according to an embodiment of the present invention at an angle from above.

FIG. 1 shows a perspective representation of the inclined roll straightening machine 1 according to the invention at an angle from above. In the representation it can be seen that the machine 1 has a frame 2 as central element, which, as a carrier, supports the essential functional units of the straightening machine 1. This frame 2 consists first of all of two vertical carrier plates 3, 4, which are held together by means of two upper longitudinal carriers 5, 6 as well as two lower longitudinal carriers 7, 8 (of which, in FIG. 1, only the first longitudinal carrier 7 is represented). The carrier plates 3, 4 and the longitudinal carriers 5, 6, 7, 8 together form a self-supporting construction on which the additional units and elements of the roll straightening machine 1 are fastened or suspended.

In the representation of FIG. 1 it can already be seen that, in addition to the longitudinal carriers 5, 6, 7, 8, the roll straightening machine 1 comprises rails formed as rods with circular cross section, whose hydraulic nuts 9, 10, 11, 12 protrude from the carrier plate 3.

The rails of the frame 2 form the central elements in the construction of the roll straightening machine according to the invention. In order to describe said roll straightening machine more precisely, we will now turn to the representation of FIG. 2.

Figure 2:
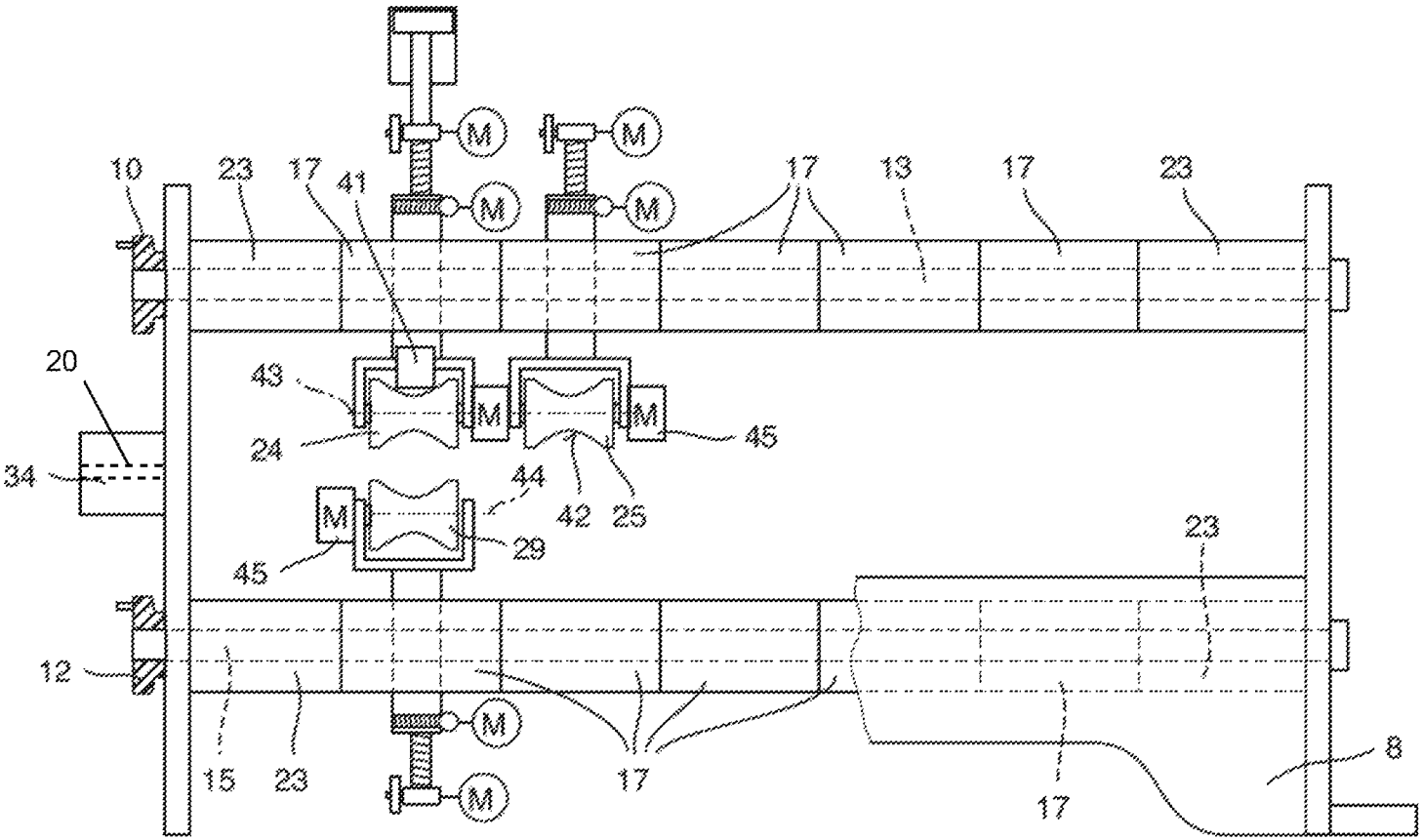
FIG. 2 shows a partially cutaway schematic side view of the roll straightening machine of FIG. 1.

On the left side of FIG. 2, one can clearly see two of the four hydraulic nuts 10, 12, and in their extension in a longitudinal direction the respective associated rails 13, 15. The rails form, in pairs, an upper pair of rails 13, 13' and a lower pair of rails 15, 15' (FIG. 4). The rails 13, 15 are all parallel to one another and arranged in pairs vertically one above the other.

The upper and the lower rolls of the roll straightening machine 1 are received on and supported by the rails 13, 15, by means of corresponding holding means 17. In the represented embodiment, the straightening machine 1 comprises five pairs of upper rolls 24, 25 and lower rolls 29. For the sake of simplicity only two upper rolls 24, 25 and a lower roll 29 of this total of 10 rolls are represented in FIG. 2. Each roll of a pair of rolls is suspended by means of a holding means 17 on a rail pair. Here, all the upper rolls 24, 25 are suspended on the upper rails 13, while the lower rolls 29 are suspended on the lower rails 15.

The tube to be straightened 20, can be an elongated string member that during the operation of the machine 1, extends in a longitudinal direction through said machine from an inlet 34 to an outlet. As shown in FIG. 5, in order to form an inclined roll straightening machine 1, the rotation axis of all the rolls are oriented at an angle relative to the tube to be straightened in the straightening machine, i.e., they are oblique with respect to the tube to be straightened.

In FIG. 2, the rotation axis of the first upper straightening roll 24 and of the first lower straightening roll 29 are drawn in as examples and provided with the reference numerals 43, 44. In addition, in each case the rotation axis 43, 44 of two rolls of a pair of upper and lower rolls are arranged at an angle with respect to one another, i.e., also oblique with respect to one another (FIG. 5).

The profile of the outer surface of each individual roll 24 to 33 is hyperbolic in a sectional plane along the radius of the rolls. Each one of the rolls has its own drive motor 45, so that, when the rolls are engaged with the product to be straightened, i.e., the steel tube to be straightened, the rolls transport the tube from the inlet 34 to the outlet.

As shown in FIGS. 2 and 4, one of the holding means 17 has two through holes 16 that have the same center-to-center distance as the rails 13 and 15, so that the holding means 17 in each case can be slid onto a pair of rails 13, 15.

Obviously, by sliding or pulling the holding means 17 on or off the rails 13, 15, the rolls can be exchanged simply, or different configurations of roll arrangements can be provided. In particular, it is possible to implement a ten-roll straightening machine with five pairs of upper and lower rolls (this configuration is shown in the figures) and to convert said machine, by removing a pair of upper and lower rolls with their holding means 17, into an eight-roll straightening machine.

In order to make this modularity of the machine 1 possible, all the holding means 17 are constructed identically. In particular, they have identical dimensions of their cuboid base body.

In the embodiment shown, the longitudinal extension of each rail 13, 15 between the hydraulic nut 9, 10, 11, 12 and the stop 4 is a whole-number multiple, namely the fivefold multiple, of the longitudinal extension of a single holding means 17 plus a residual length. In the implementation of a ten-roll straightening machine, the amount of space remaining at the front and at the back on each pair of rails 13 and 15, that is to say the residual length, is filled by means of spacers 23, which have the same construction as the holding means 17, wherein, however, no rolls are received on these spacers 23. Together, the spacers 23 received on a rail have a longitudinal extension which is approximately equal to the residual length.

If a straightening machine 1 with a smaller number of rolls is to be implemented, then, on each pair of rails, one or more holding means are replaced by place holders that have the same longitudinal extension as a single holding means.

In order to achieve the desired stability, conical rings of each holding means, which enclose the rails 13 and 15 concentrically, engage in the recesses complementary thereto of the respective adjacent holding means 17.

In addition, by means of the hydraulic nuts 9, 10, 11, 12 which push against the respective first holding means or a spacer element, the holding means are clamped against a stop of the rails 13, 15, stop which is formed by a carrier plate 4 located in the back viewed in a longitudinal direction.

Figure 3:
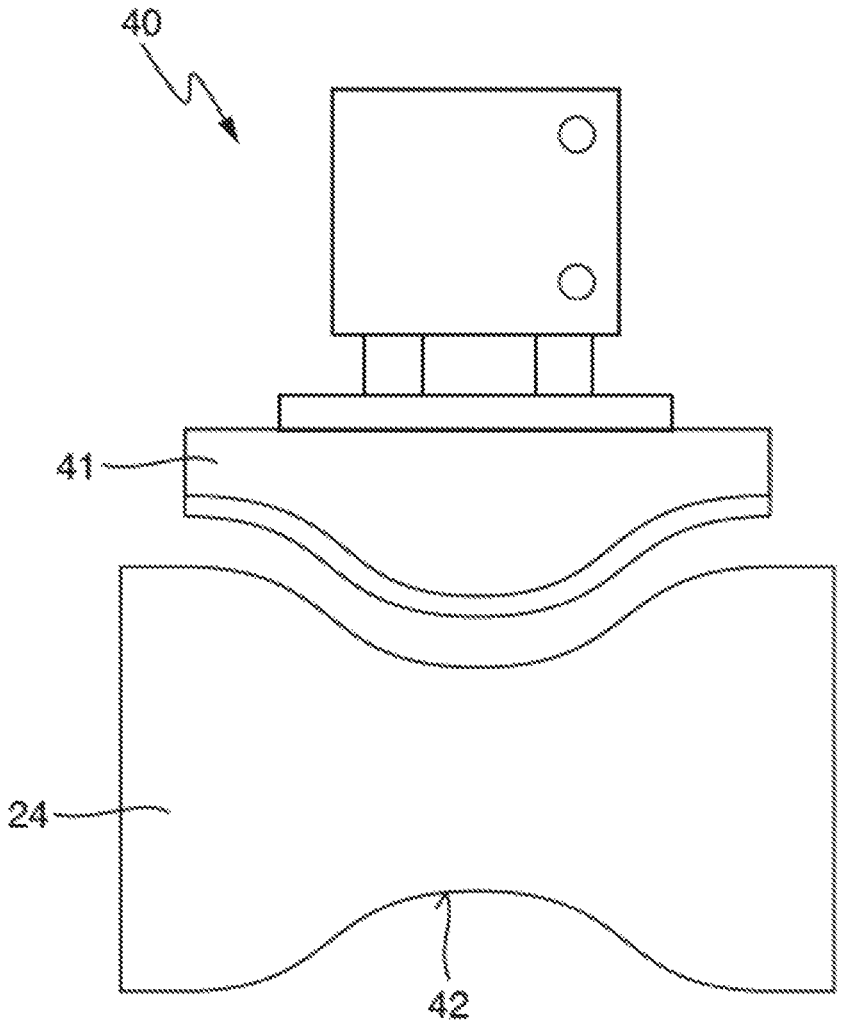
FIG. 3 shows a schematic side view of a polishing means for the rolls of the roll straightening machine of FIGS. 1 and 2.

In addition, in the schematic side view of FIG. 3, one can see that each one of the rolls has its own polishing means 40 (these are not represented in FIGS. 1 and 2), which makes it possible to feed a polishing stamp 41 in the radial direction towards the roll surface 42, so that the polishing stamp 41 engages with the roll surface 42 and polishes said roll surface when the roll 24 rotates.

For the purposes of the original disclosure, it is pointed out that all the features accessible to a person skilled in the art from the present description, the drawings and the claims, even though they have been described in concrete terms only in combination with certain additional features, can be combined, both alone and also in any desired combination, with other features or groups of features disclosed herein, to the extent that this is not explicitly ruled out or that technical circumstances make such combinations impossible or meaningless. A comprehensive, explicit description of all the conceivable combinations of features is dispensed with herein only for the sake of brevity and readability of the description.

While the invention has been represented and described in detail in the drawings and in the preceding description, this representation and description have been provided only as examples and are not intended as a limitation of the scope of protection as defined by the claims. The invention is not limited to the disclosed embodiments.

Modifications of the disclosed embodiments are evident to the person skilled in the art from the drawings, the description and the appended claims. In the claims the word "comprise" does not exclude other elements or steps, and the indefinite article "a" does not exclude a plural. The mere fact that certain features are claimed in different claims does not rule out their combination. Reference numerals in the claims are not intended as a limitation of the scope of protection.

The invention claimed is:

1. A roll straightening machine for straightening an elongated string member, comprising:

a frame including a first pair of rails and a second pair of rails;

a first straightening roll having a first rotation axis;

a second straightening roll having a second rotation axis, the first and second straightening rolls each being motor-driven, wherein each of the first and second rotation axes are oblique with respect to a longitudinal axis of the elongated string member to be received in the roll straightening machine, and wherein the first and second rotation axes are oblique with respect to one another;

a first holding device arranged to support the first straightening roll for rotation about the first rotation axis; and a second holding device arranged to support the second straightening roll for rotation about the second rotation axis, wherein the first and the second holding devices are supported by the frame in a removable manner, wherein the first pair of rails and the second pair of rails each include a plurality of locations to receive holding devices, wherein the first and the second holding devices each have a pair of through holes, wherein the first pair of rails extends through the pair of through holes of the first holding device and the first holding device is positioned at one of the plurality of locations of the first pair of rails, and wherein the second pair of rails extends through the pair of through holes of the second holding device and the second holding device is positioned at one of the plurality of locations of the second pair of rails.

2. The roll straightening machine according to claim 1, further comprising a plurality of additional holding devices, each additional holding device including a straightening roll, wherein, on each pair of rails, at least one of the plurality of additional holding devices is received, and wherein the number of the additional holding devices received on each pair of rails is the same.

3. The roll straightening machine according to claim 1, wherein one or both of the first holding device and the second holding device includes a substantially cuboid body.

4. The roll straightening machine according to claim 1, wherein the first and second holding devices have an identical construction.

5. The roll straightening machine according to claim 1, wherein the first pair of rails is arranged beneath the second pair of rails on the frame, and wherein each rail within the first pair rails and the second pair of rails extend parallel to one another.

6. The roll straightening machine according to claim 1, wherein a first polishing device is provided on the first holding device, the first polishing device being arranged such that, during the operation of the straightening machine, the first polishing device polishes the first straightening roll, and wherein a second polishing device is provided on the second holding device, the second polishing device being arranged such that, during the operation of the straightening machine, the second polishing device polishes the second straightening roll.

7. The roll straightening machine according to claim 6, wherein at least one of the first polishing device and the second polishing device includes a motor-driven polishing punch.

8. The roll straightening machine according to claim 1, wherein at least one rail of the first pair of rails includes a stop on a first end and a thread on a second end, wherein, on the thread, a first nut is arranged, and wherein the first nut clamps holding devices that are mounted on the at least one rail of the first pair of rails against each other and against the stop.

9. The roll straightening machine according to claim 8, wherein the first nut is a hydraulic nut.

10. The roll straightening machine according to claim 8, wherein the first holding device is movable relative to the first pair of rails by sliding the first pair of rails through the through holes of the first holding device, and wherein the second holding device is movable relative to the second pair of rails by sliding the second pair of rails through the through holes of the second holding device.

11. The roll straightening machine according to claim 8, wherein at least one rail of the second pair of rails includes a stop on a first end and a thread on a second end, wherein, on the thread, a second nut is arranged, and wherein the second nut clamps holding devices that are mounted on the at least one rail of the second pair of rails against each other and against the stop.

12. The roll straightening machine according to claim 11, wherein the second nut is a hydraulic nut.

13. A method for producing an elongated string member, comprising the steps:

providing an elongated string member to be straightened; and straightening the elongated string member with a roll straightening machine according to claim 1.

14. A roll straightening machine for straightening an elongated string member, comprising:

a frame including a first rail and a second rail;

a first straightening roll having a first rotation axis;

a second straightening roll having a second rotation axis, the first and second straightening rolls each being motor-driven, wherein each of the first and second rotation axes are oblique with respect to a longitudinal axis of the elongated string member to be received in the roll straightening machine, and wherein the first and second rotation axes are oblique with respect to one another;

a first holding device arranged to support the first straightening roll for rotation about the first rotation axis; and a second holding device arranged to support the second straightening roll for rotation about the second rotation axis, wherein the first and the second holding devices are supported by the frame in a removable manner, wherein the first rail and the second rail each include a plurality of locations to receive holding devices, wherein at least one of the first rail and the second rail includes a stop on a first end and a thread on a second end, wherein, on the thread, a first nut is arranged, and wherein the first nut clamps holding devices that are mounted on the at least one of the first rail and the second rail against each other and against the stop.

15. The roll straightening machine according to claim 14, further comprising a plurality of additional holding devices, each additional holding device including a straightening roll, wherein, on each rail, at least one of the plurality of additional holding devices is received, and wherein the number of additional holding devices received on each rail is the same.

16. The roll straightening machine according to claim 14, wherein one or both of the first holding device and the second holding device includes a substantially cuboid body.

17. The roll straightening machine according to claim 14, wherein the first and second holding devices have an identical construction.

18. The roll straightening machine according to claim 14, wherein the first nut is a hydraulic nut.

19. The roll straightening machine according to claim 14, wherein the first and the second holding devices each have a through hole, wherein the first rail extends through the through hole of the first holding device and the first holding device is positioned at one of the plurality of locations of the first rail, and wherein the second rail extends through the through hole of the second holding device and the second holding device is positioned at one of the plurality of locations of the second rail.

20. The roll straightening machine according to claim 14, wherein a first polishing device is provided on the first holding device, the first polishing device being arranged such that, during the operation of the straightening machine, the first polishing device polishes the first straightening roll, and wherein a second polishing device is provided on the second holding device, the second polishing device being arranged such that, during the operation of the straightening machine, the second polishing device polishes the second straightening roll.

21. The roll straightening machine according to claim 20, wherein at least one of the first polishing device and the second polishing device includes a motor-driven polishing punch.

22. A method for producing an elongated string member, comprising the steps:

providing an elongated string member to be straightened; and straightening the elongated string member with the roll straightening machine according to claim 14.

* * * * *